United States Patent [19]

Dunlap et al.

[11] Patent Number: 4,665,859

[45] Date of Patent: May 19, 1987

[54] FINGER-TYPE DOCTOR BLADE HOLDER

[75] Inventors: Harold E. Dunlap, St. Petersburg, Fla.; Ronald F. Goodnow, Leciester, Mass.

[73] Assignee: Thermo Electron-Web Systems, Inc., Auburn, Mass.

[21] Appl. No.: 807,540

[22] Filed: Dec. 11, 1985

[51] Int. Cl.[4] ..... B05C 11/04

[52] U.S. Cl. ..... 118/126; 15/256.51; 118/261

[58] Field of Search ..... 118/126, 119, 123, 261; 15/256.51

[56] References Cited

U.S. PATENT DOCUMENTS

| | | | |
|---|---|---|---|
| 3,163,878 | 1/1965 | Smith et al. | 15/256.51 |
| 3,748,686 | 7/1973 | Winterburn et al. | 15/256.51 |
| 3,803,665 | 4/1974 | Winterburn et al. | 118/126 X |
| 4,192,709 | 3/1980 | Dunlap | 15/256.51 X |

*Primary Examiner*—John P. McIntosh

*Attorney, Agent, or Firm*—Samuels, Gauthier, Stevens & Kehoe

[57] ABSTRACT

A finger-type doctor blade holder has a plurality of pressure fingers spaced along the underside of a loading plate. A doctor blade is removably supported in recesses defined between the pressure fingers and the loading plate, and the pressure fingers are mounted for pivotal movement about an axis extending across the surface to be doctored. A flexible loading tube is located alongside the finger pivot axis in a tube tray, and a force transmitting member is interposed between the pressure fingers and the loading tube. The rigidity of the force transmitting member prevents upward bulging of the loading tube between the pressure fingers, and the surface of the loading tube is indented by either the force transmitting member or a separate member at the base of the tube tray. The indentation in the tube surface enables the tube to act as a rolling diaphragm when compensating for variations in the distance between the pressure fingers and the base of the tube tray.

15 Claims, 15 Drawing Figures

FINGER-TYPE DOCTOR BLADE HOLDER

BACKGROUND OF THE INVENTION

1. Field of the Invention

This invention relates generally to doctor blade holders, and is concerned in particular with an improvement to that class of holders commonly referred to as "finger-type doctor blade holders".

2. The Prior Art

A typical example of a prior art finger-type doctor blade holder is illustrated in FIGS. 1–8. The doctor blade holder includes a finger plate subassembly 10 connected to a tube tray subassembly 12 by means of a full length pivot rod 14. The finger plate subassembly includes a full length loading plate 16 having a plurality of mutually spaced pressure fingers 18 attached to the underside thereof. The loading plate 16 and pressure fingers 18 cooperate in defining noncontinuous recesses 20 adapted to removably receive and support a doctor blade 22. The finger plate subassembly 10 thus constitutes a somewhat flexible structure which displays reactions to applied loads that are governed primarily by the bending and torsional deflection characteristics of the loading plate 16.

The tube tray subassembly 12 includes a full length tray 24 supporting a plurality of mutually spaced upstanding pivot rod brackets 26. Typically, the pressure fingers 18 will be arranged on 2" centers, and the pivot rod brackets will be on 6" centers and located between selected pairs of pressure fingers. Two flexible elongated loading tubes 28 and 30 are loosely retained in the tray on opposite sides of the pivot rod 14. The tray 24 is normally detachably secured to a structural support commonly called a "doctor back" (not shown), and the pivot rod 14 is inserted through aligned holes in the fingers 18 and the brackets 26 to pivotably interconnect the two subassemblies 10, 12.

The loading tubes 28, 30 are connected to a fluid pressure source "S", typically compressed air, with control valves $V_1$, $V_2$ interposed therebetween to control the application of pressure to the tubes.

After the blade holder has been mounted on the doctor back and properly aligned with respect to the surface 32 to be doctored, subsequent blade adjustments are made by controlling the differential fluid pressure applied to the loading tubes 28, 30. For example, when a significantly greater fluid pressure is applied to tube 28, the finger plate subassembly 10 is pivoted in a clockwise direction as viewed in FIG. 1 to disengage the doctor blade 22 from the surface 32. This is normally done in order to permit blade edge cleaning or blade replacement. Conversely, when the fluid pressure applied to tube 30 significantly exceeds that applied to tube 28, the finger plate subassembly 10 is pivoted in a counterclockwise direction towards surface 32, thereby producing bending deflections in the doctor blade 22 and loading plate 16 and increasing the loading force that the contacting blade edge applies to surface 32.

Loading tubes used in finger-type doctor blade holders are normally constructed of resilient materials sheathed with a fabric reinforcement which provides flexibility but prevents any significant tube wall elongation. When a tube of this type is internally pressurized and externally unrestrained, it will assume a cylindrical shape as shown in FIG. 4, with a diameter "D". Variations in internal tube pressure do not produce significant variations in this diameter.

However, as shown in FIGS. 3 and 5, if a loading tube such as for example tube 30 is confined between an essentially flat first reaction surface 34 on the underside of a pressure finger 18 and a second parallel reaction surface 36 provided by the bottom of the tube tray 24, and if the distance "H" between the two reaction surfaces is less than the unrestrained diameter D of the inflated tube, the tube will assume a flattened shape which may be described as two opposing semi-cylinders whose centers are separated by a distance "W". The internally applied fluid pressure on the two opposing semi-cylinders are statically balanced and thus do not exert any force on the fingers 18. The distance W is the effective width of the tube where contact exists with the individual fingers. Directly under each finger, the following relationship exists:

$$W=(\pi/2)(D-H)$$

It thus will be seen that although a loading tube is uniformly pressurized throughout its length, the forces applied to individual fingers will vary roughly inversely to the distance H between each individual finger and the bottom surface of the tube tray.

Between the fingers, as illustrated in FIG. 6, the tube will assume a shape more nearly approaching the normal cylindrical unrestrained shape shown in FIG. 4. The final stabilized tube shapes between the fingers are however, influenced by tensile stresses developed in the reinforcing fabric of the tube sheathe in the direction of the major tube axis, as indicated schematically in FIG. 3 at "T".

The actual cross sectional shape of the tube at any given location between two fingers is not readily predictable due to variables such as the physical characteristics of the tube and its sheathing and the unsupported distance between fingers. Consequently, the shape shown in FIG. 6 is a generalized estimated shape. It is apparent, however, that the effective width W' at locations between the fingers will always be less than the width W under a finger.

Much of the potential loading force of the tube between the fingers is dissipated in producing the longitudinal tension T in the tube and its sheathe. Only a small portion of this tension is resolved into vertically acting forces "V" to provide additional finger loading.

In light of the foregoing, it will be seen that the use of finger-type blade holders does not assure uniformity or consistency of blade loading on the surface 32 to be doctored. For example, as shown in FIG. 7, as the doctor blade 22 wears, the loading tube 30 must expand to maintain blade contact with the surface 32 being doctored. The increase of dimension H results in a reduction of the effective width W, with an accompanying reduction in blade loading.

As shown in FIG. 8, the opposite effect will be experienced if the blade 22 is forced upwardly by the intrusion of foreign material between the surface 32 being doctored and the blade edge. Here, the tube 30 will be flattened to a greater extent as the dimension H decreases, with a resulting increase in effective width W and an increase in blade loading.

Thus it will be seen that should mismatches between the surface 32 and blade profile exist, the inherent flexibility of the finger plate subassembly 10 will usually allow the tube 30 to force a continuous contact by varying the dimension H. Effective tube width W, and consequently blade loading profile, is proportionally varied.

It has now been determined that this relatively high degree of flexibility and inherent ability of the conventional finger-type blade holder to conform may in certain instances be disadvantageous. More particularly, if the doctor blade 22 conforms to an intrusion of foreign material carried under the blade edge by the moving surface 32, the resulting increased load concentration at that point may be insufficient to cut through the foreign material, with the result that the doctoring operation will be seriously impaired. The reason for this is that the tube loading force between the fingers 18 is largely dissipated in creating tensile stresses T in the tube and its sheathing, with only a small portion of the tube loading force being resolved into vertically acting forces V to provide the required additional finger loading.

SUMMARY OF THE INVENTION

An objective of the present invention is to minimize the loss of effective tube loading forces between the fingers, thereby causing a greater load concentration to be imposed on material intruding between the blade edge and the surface being doctored. This enhances the ability of the blade to cut through the intruding material and to subsequently remove or doctoroff additional materials being carried forward by the moving surface being doctored.

Another objective of the present invention is to minimize the variations in effective tube width W as the individual fingers adjust to accommodate variations in the blade profile.

In accordance with one aspect of the present invention, a force transmitting member in the form of a rod or a bar is interposed between the pressure fingers and the loading tube. The force transmitting member has greater rigidity than the rigidity of the tube surface when the latter is inflated. The force transmitting member extends continuously over the length of the loading tube, and thus bridges the gaps between the pressure fingers. The presence of the load transmitting member does not adversely affect the ability of the blade holder assembly to conform to long span mismatches such as crowns provided in the surface being doctored or to deflections in the doctor back. However, over the relatively short spans which exist between individual fingers, the increased rigidity provided by the force transmitting member is sufficient to prevent tube bulging between fingers, thereby effectively transmitting full tube loading forces to the finger plate subassembly. This concentrates and increases blade loading upon any foreign materials which may have intruded beneath the blade edge.

In one embodiment of the invention, the force transmitting member has a cylindrical surface which is impressed into and partially surrounded by the surface of the pressurized loading tube. The resulting modification of the tube's cross sectional configuration enables the tube to function as a rolling diaphragm when adjusting to variations in the dimension H. The changes in effective tube width W which normally accompany the variations in the dimension H are thus significantly reduced.

In another embodiment, the force transmitting member is essentially flat, and the tube tray is provided with a cylindrical protrusion underlying the loading tube.

DESCRIPTION OF ILLUSTRATED EMBODIMENTS

Figure 1:
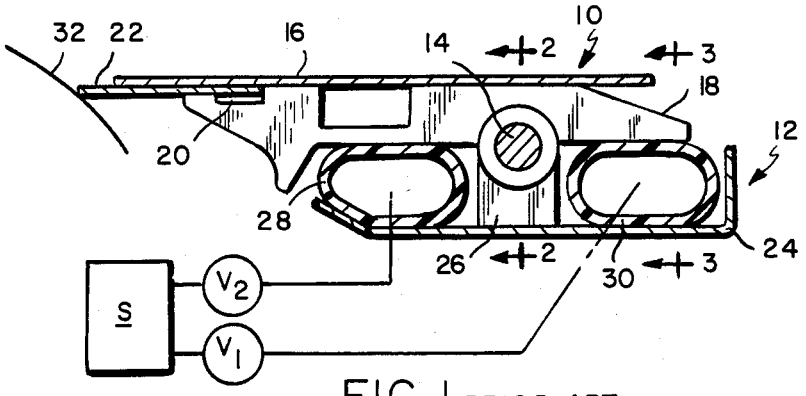
FIG. 1 PRIOR ART
FIG. 1 is a cross sectional view taken through a prior art finger-type doctor blade holder.
Figure 2:
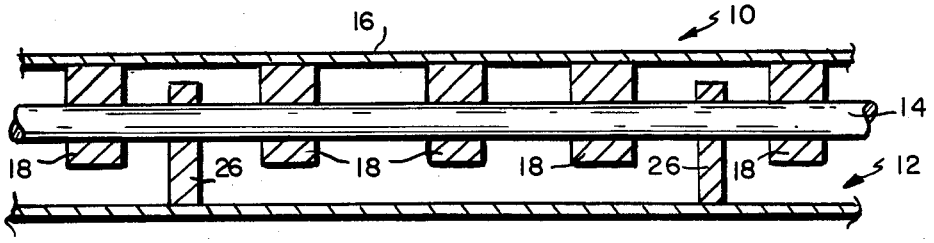
FIG. 2 PRIOR ART
FIGS. 2 and 3 are partial sectional views taken respectively along lines 2—2 and 3—3 of FIG. 1.
Figure 3:
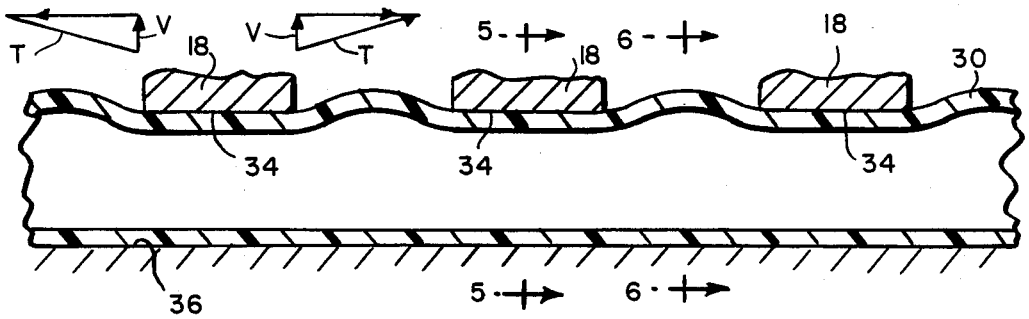
FIG. 3 PRIOR ART
Figure 4:
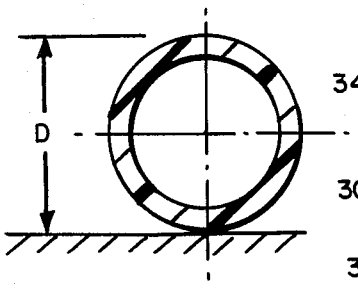
FIG. 4 is a cross sectional view taken through a typical pressurized loading tube in an unrestrained state.
Figure 5:
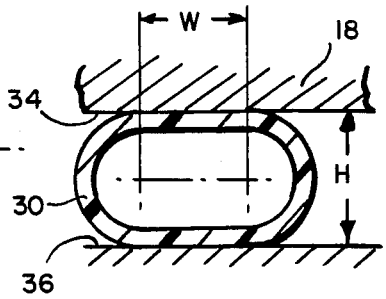
FIG. 5 PRIOR ART
FIGS. 5 and 6 are cross sectional views taken respectively along lines 5—5 and 6—6 of FIG. 3.
Figure 6:
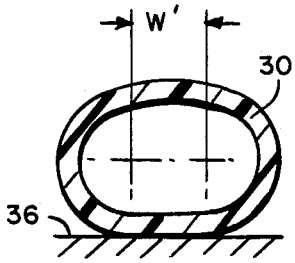
FIG. 6 PRIOR ART

Referring to FIGS. 9–15, two embodiments of a doctor blade assembly in accordance with the present invention will now be described. Those components which are common to the previously described prior art doctor blade holder have been identified with the same reference numerals.

Figure 10:
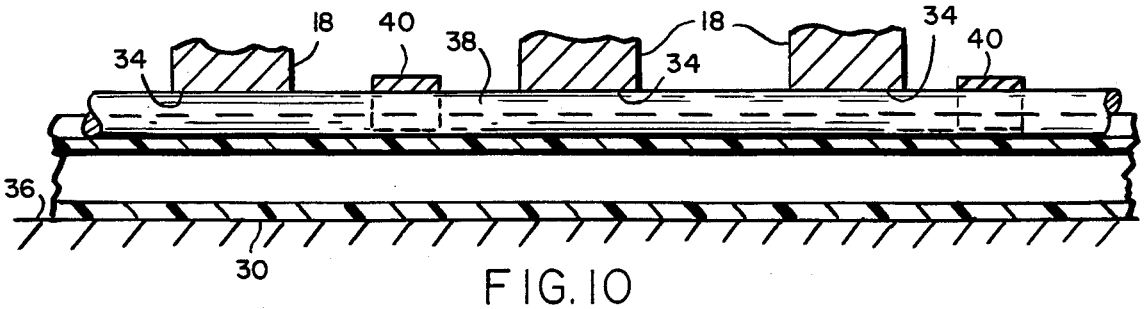
FIG. 10 is a partial sectional view taken along line 10—10 of FIG. 9.
Figure 11:
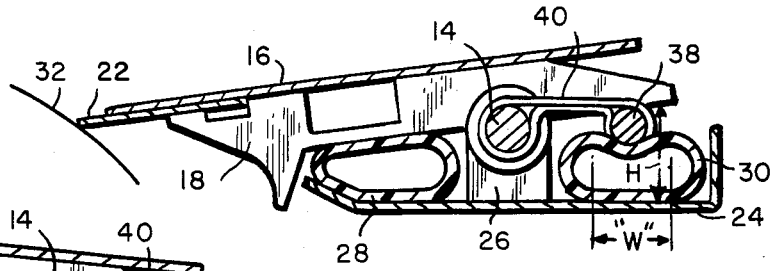
FIGS. 11 and 12 are views depicting in an exaggerated form how the loading tube of the FIG. 9 embodiment reacts to pivotal movement of the pressure fingers.
Figure 12:
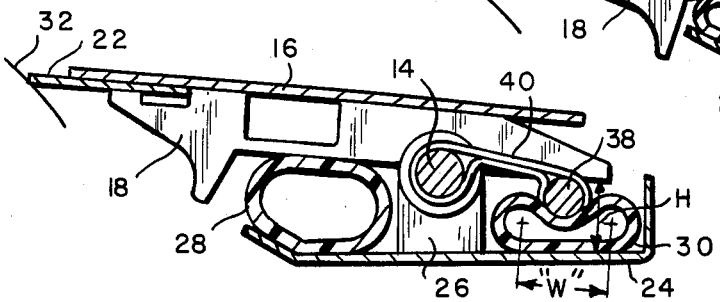

In the embodiment shown in FIGS. 9–12, a force transmitting member in the form of a continuous full length cylindrical rod 38 is interposed between the first reaction surfaces 34 of the fingers 18 and the loading tube 30. In comparison with the surface of the inflated tube, the rod 38 has much greater rigidity and resistance to localized deformation. As is best shown in FIG. 10, the rod 38 bridges the spaces between the fingers 18 and extends continuously along the length of the loading tube 30.

The rod is held in place by clips 40 which extend between and are located at appropriate intervals along the lengths of the rods 14 and 38. The clips 40 loosely surround both rods so as not to restrict free rotational movement of rod 38 about rod 14.

Figure 7:
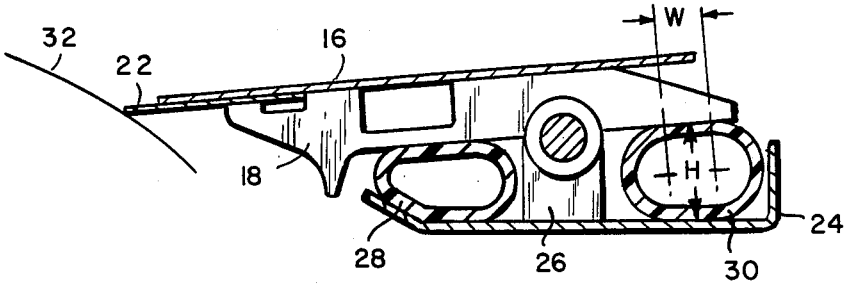
FIG. 7 PRIOR ART
FIGS. 7 and 8 are views similar to FIG. 1 depicting in an exaggerated form how the loading tube of the prior art finger-type blade holder reacts to pivotal movement of the pressure fingers.
Figure 8:
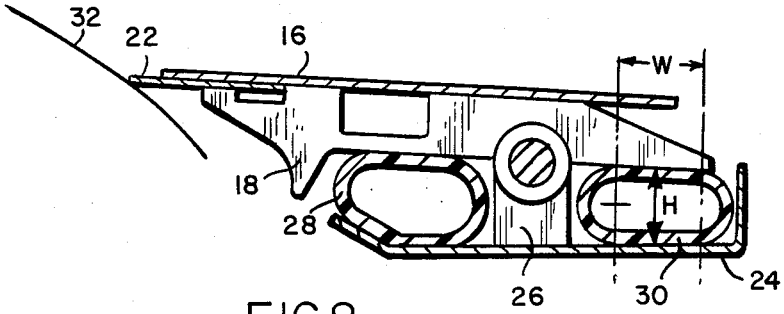
FIG. 8 PRIOR ART
Figure 9:
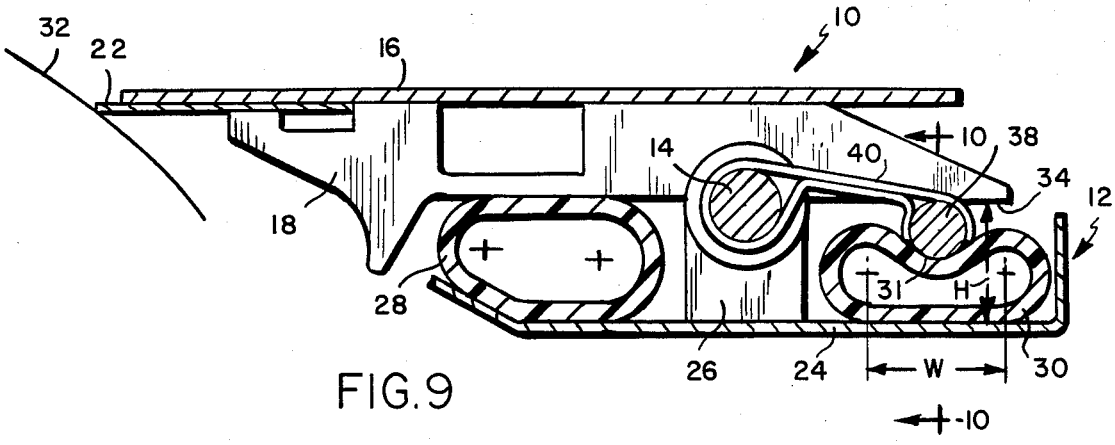
FIG. 9 is a cross sectional view taken through one embodiment of a finger-type blade holder in accordance with the present invention.

The rod 38 serves two major functions. First, as can best be seen in FIG. 9, the rod 38 is impressed into and partially surrounded by the contacting surface of the inflated tube 30, thereby modifying the cross sectional shape of the tube by creating an indentation or depression 31 in the tube surface extending longitudinally in the direction of the major tube axis. With this cross sectional configuration, the pressurized loading tube 30 functions as a rolling diaphragm when adjusting to variations of the dimension H occasioned by pivotal movement of the fingers 18, and this takes place with relatively minor accompanying variations in the effective width W of the tube. A comparison of FIGS. 11 and 12 with FIGS. 7 and 8 provides an illustration of this improved stability by showing that with the present invention, the effective tube width W remains relatively constant over a wide range of operating heights H. By properly selecting the sizing and geometrical relationships of the loading tube 30 and rod 38, variations of the dimension W can be reduced to relatively insignificant levels over normal ranges of operating heights H.

The interposition of the rod 38 between the pressure fingers 18 and the loading tube 30 also reduces the overall flexibility of the blade holder assembly. This reduction in flexibility does not adversely affect the ability of the blade holder assembly to conform to long span mismatches occasioned by crowns in the surface 32 being doctored or by deflections in the doctor back on which the blade holder assembly is supported. However, over relatively short spans such as those existing between the fingers 18, and as can best be seen in FIG. 10, the rigidity of the rod 38 eliminates bulging of the tube between the fingers. Thus, the full potential tube loading force is transmitted to the fingers, thereby providing a significantly beneficial concentration of blade loading at any location where foreign material may have intruded between the blade edge and the surface 18 being doctored. In other words, by eliminating tube bulging between the fingers 18, tube loading force is not dissipated in the creation of tensile stresses in the tube and its sheathing, but instead is fully and advantageously transmitted to the pressure fingers.

Figure 13:
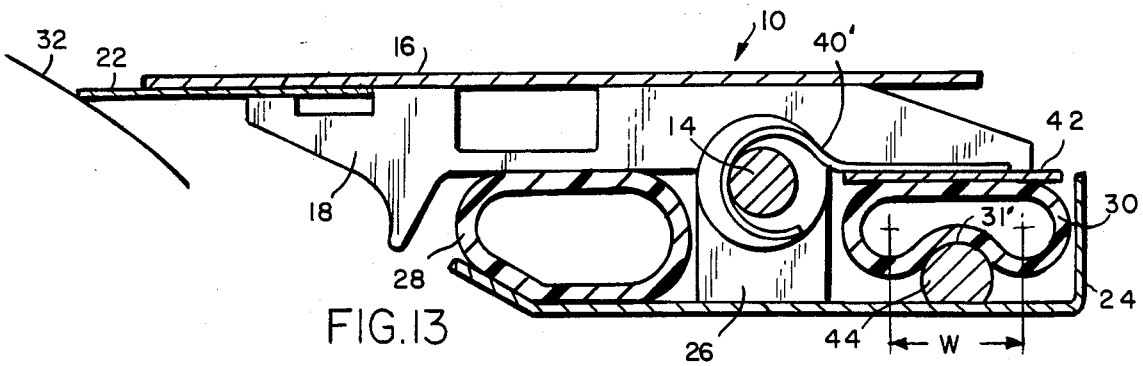
FIG. 13 is a cross sectional view taken through another embodiment of a finger-type blade holder in accordance with the present invention.
Figure 14:
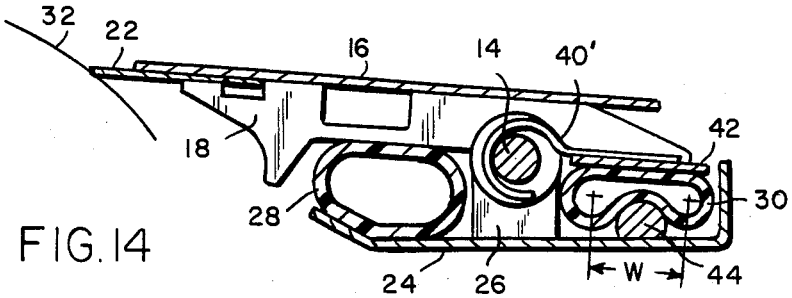
FIGS. 14 and 15 are views again depicting an exaggerated form how the loading tube of the FIG. 13 embodiment reacts to pivotal movement of the pressure fingers.
Figure 15:
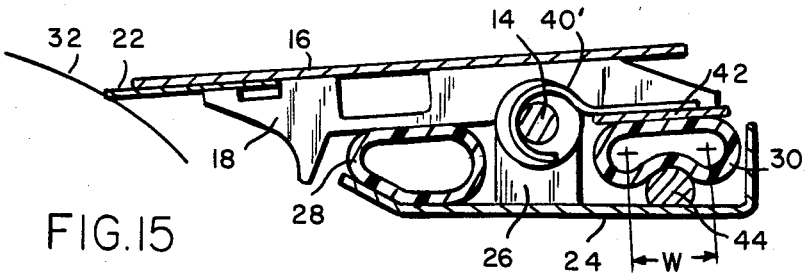

In the embodiment shown in FIGS. 13–15, the force transmitting member takes the form of a flat metal plate which again extends continuously over the length of the loading tube 30, and which is laterally located with respect to the pivot rod 14 by means of a plurality of clips 40' extending therebetween. The increased rigidity afforded by the plate 42 again serves to eliminate bulging of the loading tube 30 at locations between the fingers 18. However, the cross sectional profile of the loading tube 30 is not altered by the interposition of the plate 42 between the fingers 18 and the loading tube. Rather, in order to achieve the desired alteration in the cross sectional configuration of the loading tube, a cylindrical rod-like member 44 is interposed between the bottom of the tube tray 24 and the lower tube surface. The indentation 31 created by the rod-like member 44 accomplishes the same result as the indentation 31 provided by the rod 38 in the previously described embodiment. Thus, as illustrated in somewhat exaggerated form in FIGS. 14 and 15, the effective width W will undergo only slight changes as the pressure fingers 18 pivot about the axis of rod 14.

In light of the foregoing, it will now be appreciated by those skilled in the art that various changes and modifications may be made to the embodiments herein disclosed without departing from the spirit and scope of the invention as defined by the claims appended hereto. In this connection, it will be understood that various cross sectional configurations may be employed for the force transmitting members interposed between the fingers and the loading tubes. Under certain circumstances, it may be desirable to employ one aspect of the invention, but not the other. Thus, it is conceivable that it might be desirable to employ only the platelike force transmitting member 42 of FIGS. 13–15, without also employing the rod-like element 44 to alter the cross sectional configuration of the loading tube.

We claim:

1. A finger-type holder for a blade used to doctor a moving surface, said holder comprising:

(a) a plurality of pressure fingers laterally separated by spaces and mounted for pivotal movement about an axis located adjacent to said moving surface;

(b) means arranged on and cooperating with said fingers for removably receiving and supporting said blade; and, (c) actuating means for pivoting said fingers to forcibly apply said blade against said moving surface, said actuating means including:

(i) a flexible loading tube extending along one side of said axis, said tube being located between first reaction surfaces on said fingers and a second reaction surface which is fixed in relation to said fingers;

(ii) a force transmitting member extending coextensively with said loading tube to bridge the spaces between said pressure fingers, said force transmitting member being interposed between and in contact with said loading tube and the first reaction surfaces of said pressure fingers; and (iii) means for inflating said tube to push said force transmitting member against said first reaction surfaces.

2. The finger-type holder of claim 1 wherein said force transmitting member has a cylindrical surface which is partially surrounded by said loading to produce an indentation in the surface of said tube when said tube is inflated.

3. The finger-type holder of claim 1 wherein said force transmitting member has greater rigidity than the surface of said loading tube when said loading tube is inflated.

4. The finger-type holder of claim 3 wherein the rigidity of said force transmitting member is sufficient to prevent said loading tube from bulging upwardly between said pressure fingers.

5. The finger-type holder of claim 1 wherein said force transmitting member comrises a cylindrical rod which is partially enveloped by the surface of said loading tube when said tube is inflated, and wherein said rod serves to prevent said loading tube from bulging upwardly at locations between said pressure fingers.

6. The finger-type holder of claim 1 wherein said axis is defined by an elongated pivot rod, and wherein said force transmitting member is connected to said pivot rod by connecting members extending laterally therebetween in the spaces between said pressure fingers.

7. The finger-type holder of claim 6 wherein said pivot rod is supported by brackets extending upwardly from a base, and wherein said second reaction surface is defined by said base.

8. The finger-type holder of claim 1 further comprising a second actuating means for pivoting said fingers to move said doctor blade away from said moving surface.

9. The finger-type holder of claim 8 wherein said second actuating means comprises a second loading tube extending along the opposite side of said axis and arranged between said fingers and said second reaction surface, and means for inflating said second loading tube.

10. The finger-type holder of claim 1 wherein said second reaction surface includes a cylindrical protrusion extending coextensively with said loading tube, said protrusion being partially surrounded by said loading tube to produce a surface indentation therein when said tube is inflated.

11. A finger-type holder for a blade of the type used to doctor a moving surface, said holder comprising: a loading plate; a plurality of pressure fingers arranged along the underside of said loading plate, said fingers being laterally separated by spaces and cooperating with said loading plate to define recesses adapted to receive said blade; means for mounting said pressure fingers for pivotal movement about an axis extending across said surface; a tube tray underlying said axis; a loading tube arranged in said tray and extending beneath said fingers and alongside said axis; and a force transmitting member interposed between said pressure fingers and said tube, said force transmitting member extending across the spaces between said pressure fingers and having sufficient rigidity to prevent upward bulging of said tube between said fingers.

12. The finger-type holder of claim 11 further comprising means for producing a longitudinal surface indentation in said tube in the direction of the major tube axis.

13. The finger-type holder of claim 12 wherein said means is comprised of a cylindrical surface impressed into and partially surrounded by said surface of said tube.

14. The finger-type holder of claim 13 wherein said cylindrical surface overlies said tube and forms part of said force transmitting member.

15. The finger-type holder of claim 13 wherein said cylindrical surface underlies said tube and forms part of said tube tray.

* * * * *